United States Patent [19]

Ellenburg

[11] 4,250,861

[45] Feb. 17, 1981

[54] FOLDABLE WRIST BRACED SLINGSHOT

[76] Inventor: Howard Ellenburg, 2654 44th Ave., Columbus, Nebr. 68601

[21] Appl. No.: 952,085

[22] Filed: Oct. 17, 1978

[51] Int. Cl.[3] ..... F41B 7/00

[52] U.S. Cl. ..... 124/20 R; 124/80

[58] Field of Search ..... 124/20 R, 25, 41 R, 124/41 A, 80, 1, 16, 17, 21; 145/61 L; 81/177 ST, 177 E; 273/73 T

[56] References Cited

U.S. PATENT DOCUMENTS

| | | | |
|---|---|---|---|
| 1,730,820 | 10/1929 | Holden | 273/73 J X |
| 2,672,857 | 3/1954 | Gauthier | 124/20 R |
| 2,735,417 | 2/1956 | Denekar | 124/20 R |
| 3,901,209 | 8/1975 | Woolsey et al. | 124/20 R |

*Primary Examiner*—Richard C. Pinkham
*Assistant Examiner*—William R. Browne
*Attorney, Agent, or Firm*—Larson, Taylor and Hinds

[57] ABSTRACT

A folding slingshot having a yolk, a hand grip and elastic members connected to said yolk. A wrist brace is frictionally, detachably and pivotably mounted to the hand grip near the base thereof. Said wrist brace comprises a pair of longitudinal members diverging rearwardly from the hand grip and spaced apart to receive the wrist between them and an end member integral with said longitudinal members engageable with the user's wrist. A groove is on each side of said handle near the base thereof for receipt of end portions of said longitudinal members. A protruding stop member on said hand grip overhanges each of said grooves and prevents further rotation of said wrist brace. A cam area on said hand grip below each of said grooves containing two spaced apart cam surfaces; said end portions of the longitudinal members encountering said cam surface upon rotation toward said grooves, thereby spreading slightly said longitudinal members so that after passing over said cam surfaces said end portions of the longitudinal members snap into said grooves and rest against said respective stop members to lock said wrist brace in shooting position.

6 Claims, 8 Drawing Figures

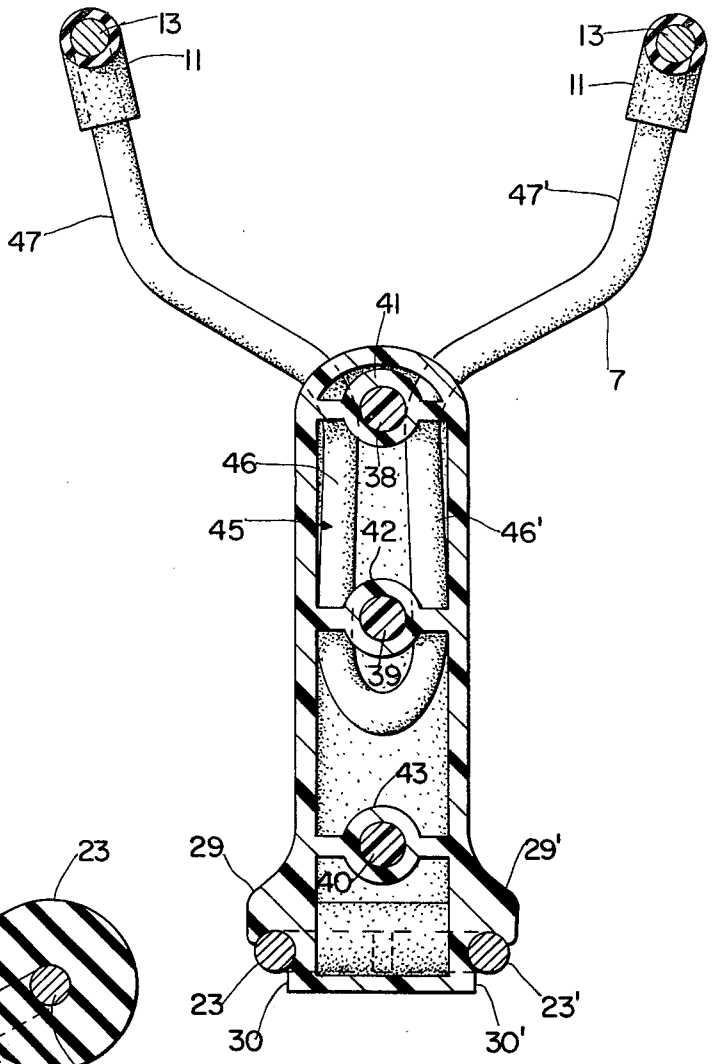
FIG. 4
FIG. 5
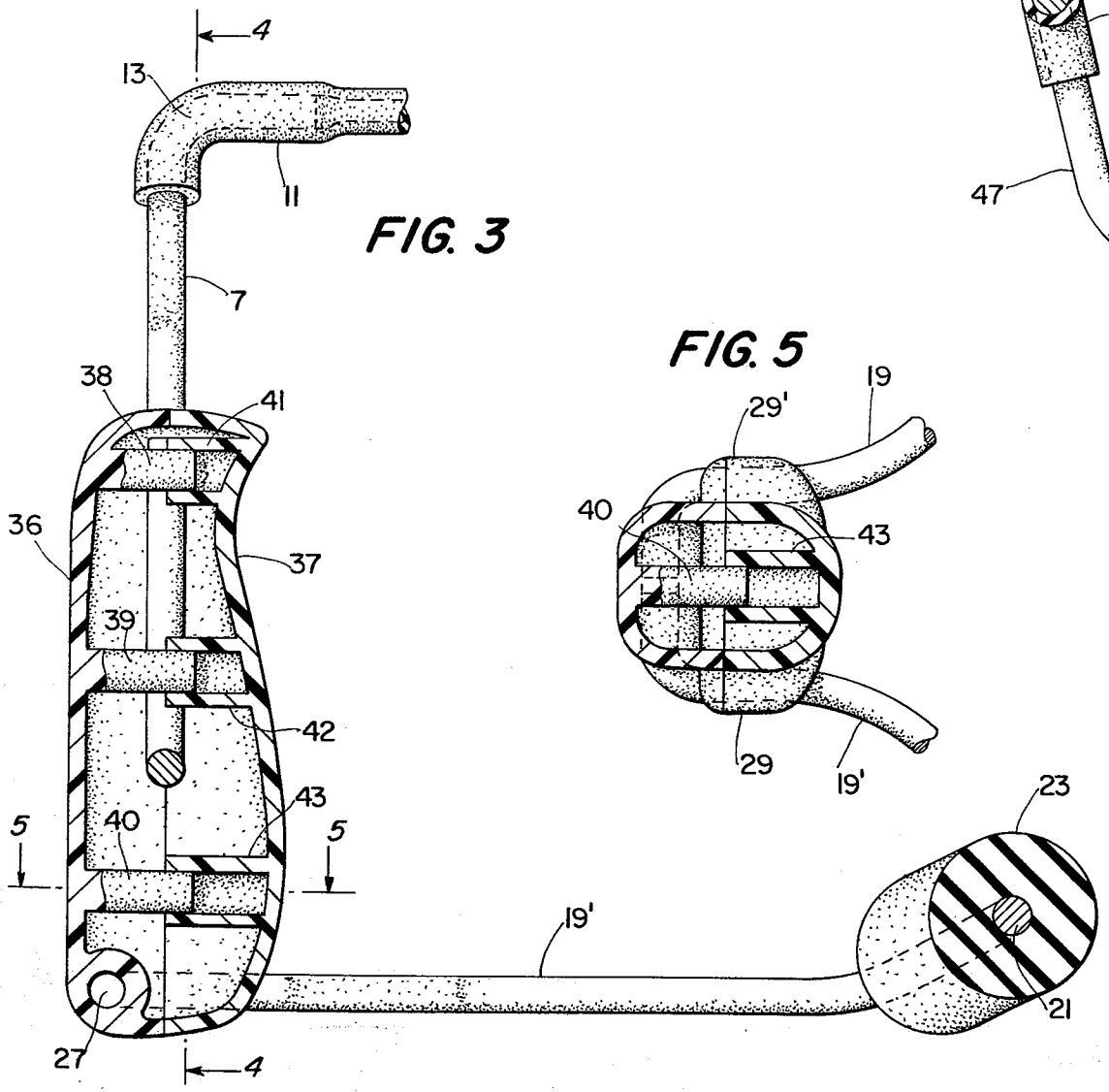
FIG. 3

FIG. 6
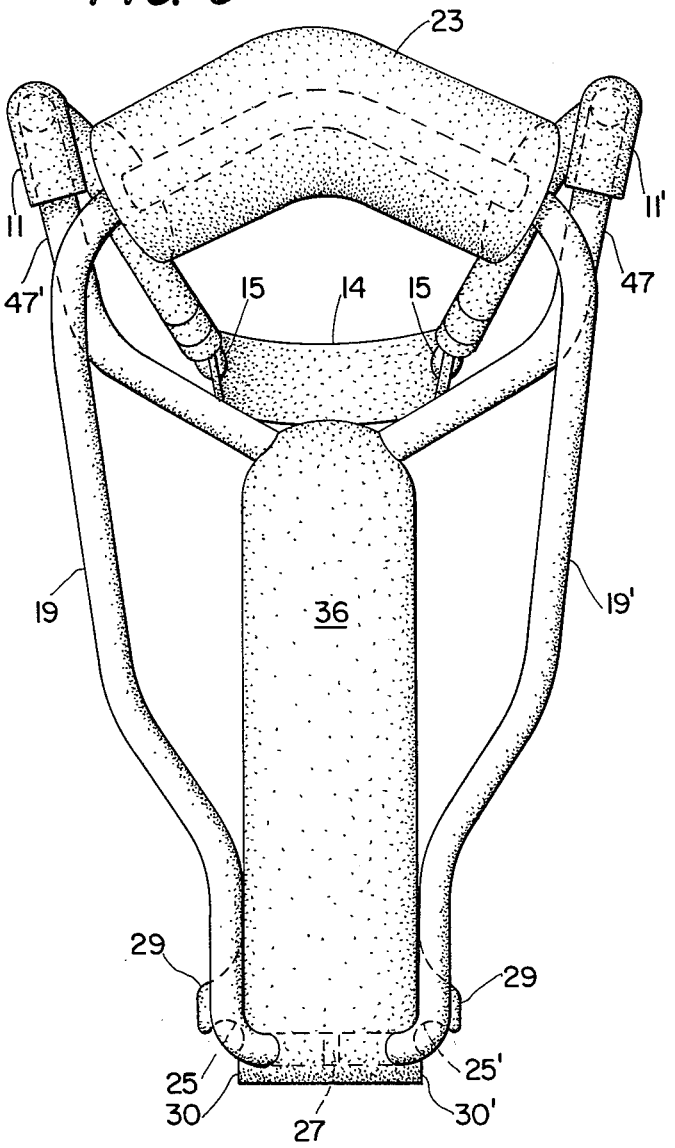
FIG. 7
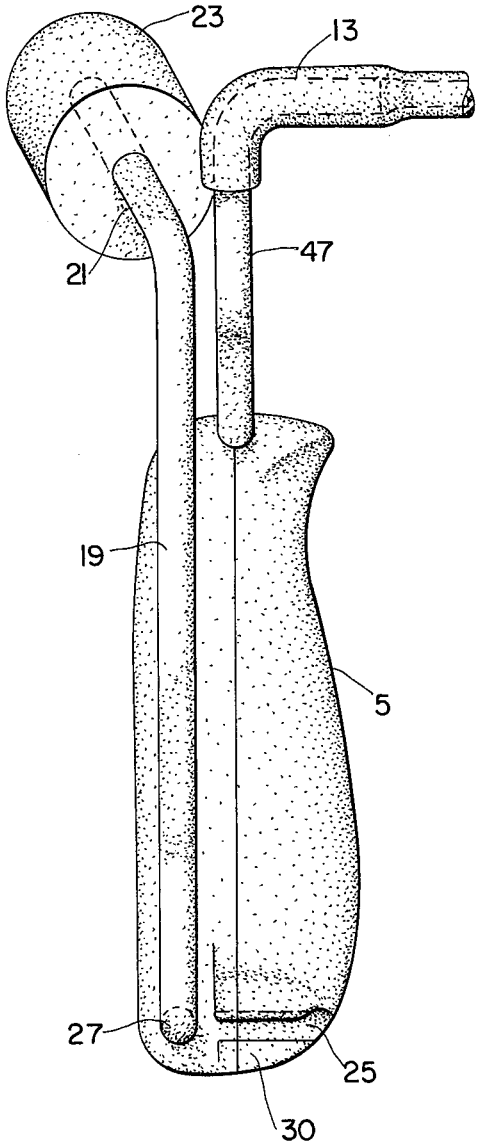
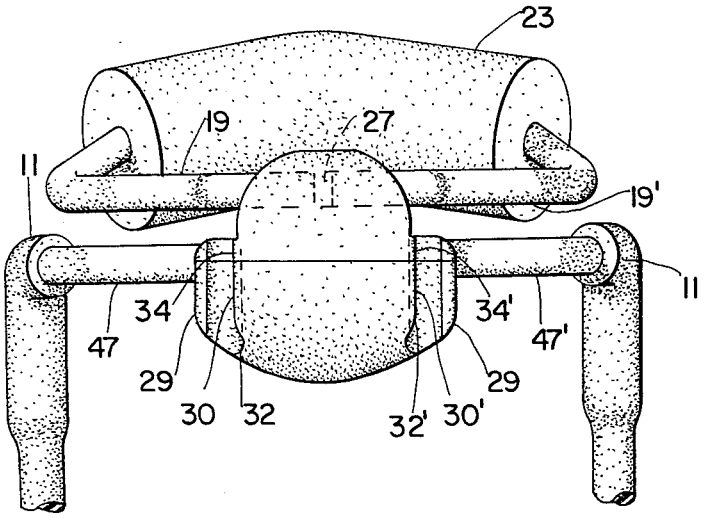
FIG. 8

FOLDABLE WRIST BRACED SLINGSHOT

BACKGROUND OF THE INVENTION

1. Field of the Invention

This invention relates to slignshots and more particularly to improved foldable slignshots having a wrist brace.

2. Description of the Prior Art

The earliest slingshots took the form of a handle having a forked element attached or integral therewith. The most common examples of these prior art slingshots and those with which most people are familiar are the slingshots fashioned by youngsters using a crotch cut from the branch of a tree. More sophisticated slingshots of this type have been developed recently, but all suffer from the same disadvantages, foremost of which is lack of accuracy due to the difficulties in holding the wrist steady while shooting. Consequently, there have been developed slingshots that include a wrist brace whose function is to engage the wrist and stabilize the slingshot so that the user can hold it more steady when discharging the shot. Slingshots of the wrist brace variety have taken numerous forms including wrist braced slingshots of the foldable type. The latter, and particularly prior art foldable, wrist braced slingshots having a frictionally and detachably secured wrist brace means have not been entirely satisfactory since most fail to maintain the desired stable, fixed or locked position necessary for accurate shotmaking.

OBJECTS OF THE INVENTION

Accordingly, it is an object of the invention to provide a slingshot having a wrist brace means which is foldable, removable and frictionally attached, yet which when placed into shooting position remains locked and rigid thereby insuring shooting accuracy for the life of the slingshot.

Another object of the invention is to provide an economically and physically attractive slingshot which is foldable in a novel manner into a convenient transportable form.

SUMMARY OF THE INVENTION

These and other objects of the invention are obtained by a folding slingshot comprising a yolk having a hand grip, elastic members connected to said yolk, wrist brace means frictionally, detachably and pivotably mounted to the hand grip near the base thereof, said wrist brace comprising a pair of longitudinal members diverging rearwardly from the hand grip and spaced apart to receive the wrist between then and an end member integral with said longitudinal members engageable with the user's wrist, a groove on each side of said handle near the base thereof for receipt of end portions of said longitudinal members, a protruding stop member on said hand grip overhanging each of said grooves for preventing further rotation of said wrist brace, a cam area on said hand grip below each of said grooves containing two spaced apart cam surfaces, said end portions of the longitudinal members encountering said cam surface upon rotation toward said grooves, thereby spreading slightly said longitudinal members so that after passing over said cam surfaces said end portions of the longitudinal members snap into said grooves and rest against said respective stop members to lock said wrist brace means in shooting position.

BRIEF DESCRIPTION OF THE DRAWING

The slingshot of the present invention will be more readily apparent from the accompanying drawing wherein like numerals are employed to designate like parts.

In the Drawing

FIG. 3 is a sectional side view of the hand grip taken along line 3—3' of FIG. 1;

FIG. 4 is a sectional rear view of the hand grip taken along line 4—4' of FIG. 3;

FIG. 5 is a sectional view taken along line 5—5' of FIG. 4;

FIG. 6 is a front elevation of the slingshot with the wrist brace means in folded position;

FIG. 7 is a fragmentary side elevation of the slingshot with the wrist brace means in folded position;

FIG. 8 is a bottom elevational view of the slingshot with the wrist brace means in a folded position.

Figure 1:
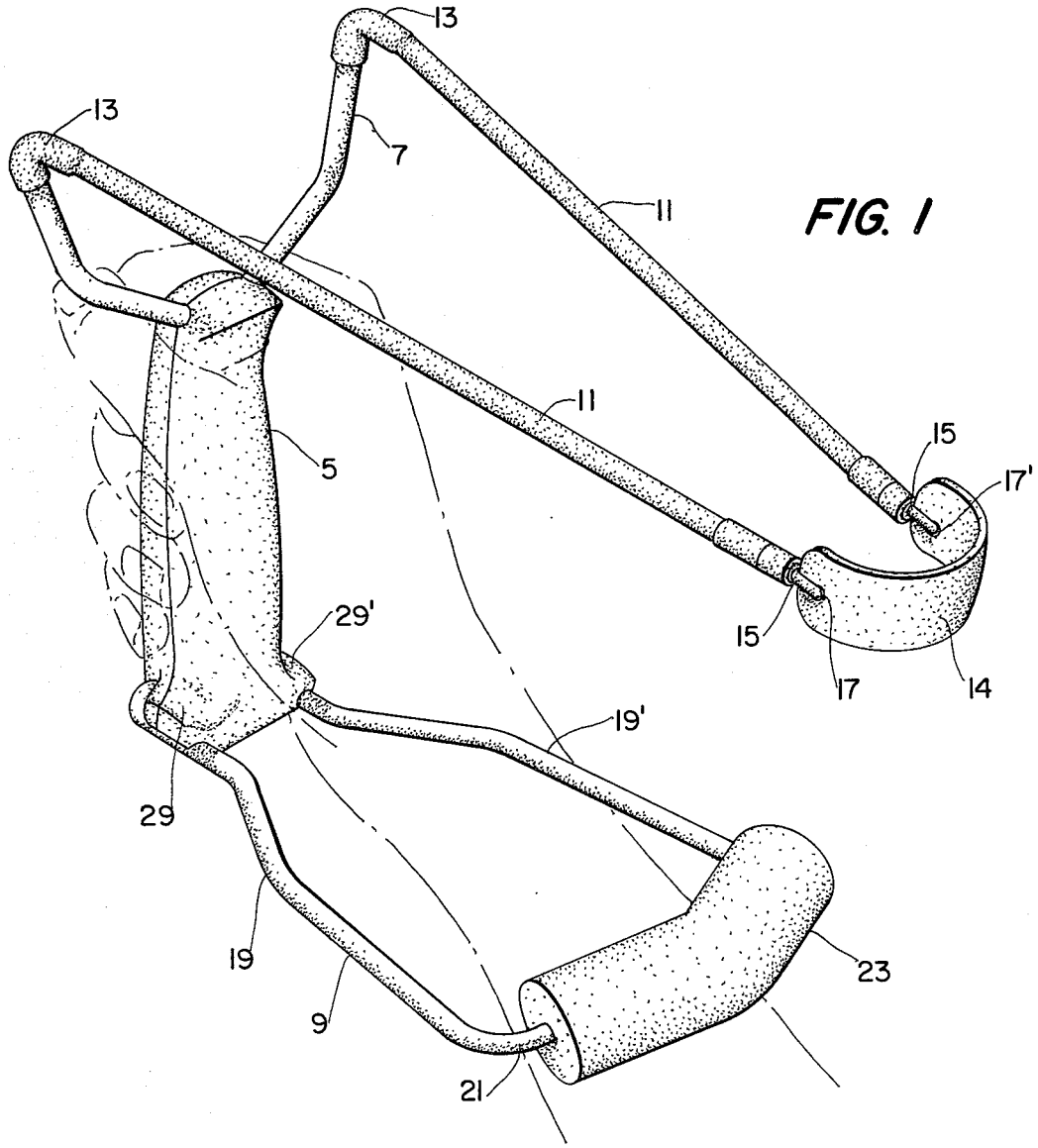
FIG. 1 is perspective of a preferred form of the slingshot of the invention in shooting position.

Referring now to the drawings and particularly FIG. 1, the hand grip is showing generally as 5, the yoke as 7 and and the wrist brace as 9. An elastic member 11, preferably of rubber tubing, is stretched over the bent ends 13 of the yolk 7 and secured thereto by adhesive. Elastic member 11 is provided with a missile pouch 14, preferably of leather. Missile pouch 14 is attached to the elastic member 11 via a slotted plastic plug 15. Attachment of the pouch 13 is effected by slipping a prong of each slotted plug 15 through eyelets 17 and 17' respectively and inserting the plug into the end of elastic tubing 11. The diameter of said plug is preferably larger than the internal diameter of said elastic tubing 11 so as to facilitate attachment. It is preferred to further secure attachment of the plug within the tubing 11 by use of a suitable adhesive.

Figure 2:
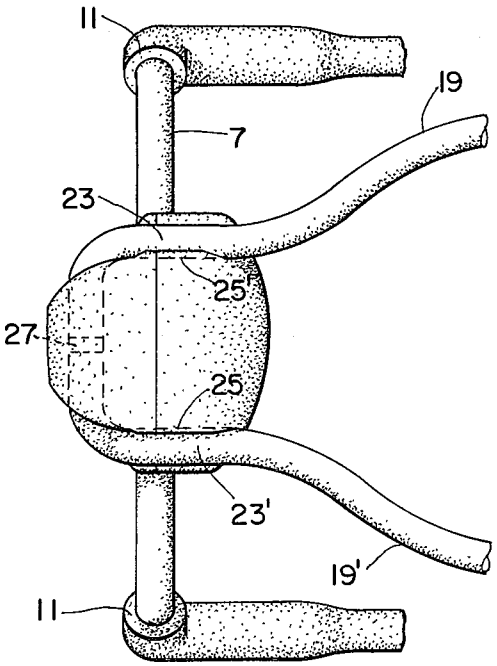
FIG. 2 is a fragmentary bottom plan view of the slingshot shown in FIG. 1.

The wrist brace means 9, preferably of a continuous metal rod, is bent so as to comprise two longitudinal members 19 and 19' and an end member 21. Longitudinal members 19, 19' diverge rearwardly and are bent in a fashion permitting receipt of the wrist therebetween. The end member 21 is engageable with the user's wrist and is advantageously provided with a cylindrical cushion member 23 of resilient material such as sponge rubber. As best shown in FIG. 2, longitudinal members 19, 19' contain end portions 23, 23' essentially parallel to each other, the ends of which portions turn inwardly for mounting onto grooves, 25, 25' and into the openings of hole 27 provided hand grip 5 as will be described in more detail below. End portions 23, 23' of the longitudinal members 19, 19' are overly bent so that when in unmounted position, the distance between end portions 23 and 23' is less than the distance between the surface of groove 25 and the surface of groove 25' on hand grip 5. Consequently, when mounted the longitudinal members 19, 19' will be held against the surface of grooves 25, 25' respectively by inwardly directed tension.

As aforementioned, the base of handle grip 5 contains two grooves 25 and 25' on each side of the grip. Preferably the grooves extend from the rear of the hand grip to the ends of hole 27. Hole 27 passes from one side of the hand grip 5 to the other on a line substantially parallel to the bottom of the handle grip 5. Above grooves 25 and 25' are overhanding stop members 29 and 29' that advantageously extend the length of the grooves. The size of the grooves is such that they will conveniently accomodate end portions 23 and 23' of longitudinal members 19 and 19' respectively. Beneath grooves 25 and 25' are cam areas indicated generally as 30 and 30'. As shown more clearly in FIG. 8, cam areas 30 and 30' each contain two cam surfaces 32, 32' and 34, 34'.

On one embodiment of the invention best illustrated in FIGS. 3–5, hand grip 5 comprises two concave halves 36 and 37. Concave half 36 contains three male members 38, 39 and 40, projecting outwardly from and perpendicular to its wall.

Concave half 37 contains three female members, 41, 42 and 43 projecting outwardly from and perpendicular to its wall which receive said male members 38, 39 and 40. Yolk 7 is inserted in handle grip 5 before halves 36 and 37 are joined and glued together. Yolk 7, as can be seen from FIGS. 4–7 comprises a continuous metal rod which has been doubled over to form a stem portion indicated generally as 45, comprised of sides 46 and 46', and then bent outwardly to form a fork portion 47, 47'. Introduction of yolk 7 into handle grip 5 is effected by first placing stem portion 45 onto either concave hole 37 or 37', so that the male or female members pass between sides 46 or 46' of stem portion 45 and then coupling and glueing together concave halves 36 and 37.

Wrist brace means 9 is pivotably mounted on hand grip 5 by spreading out the inwardly bent ends of the longitudinal members 19 and inserting them into the openings of the hole 27. Since the wrist brace is overly bent, the inward pressure of the ends of the longitudinal members pivotably mounts the brace on the hand grip 5. Once mounted, the wrist brace 9 can be rotated forward, that is, away from the shooting position, and folded up upward into contact with the forked poriton 47, 47' of said yolk 7.

When the wrist brace means 19 is rotated forward from a position in direct alignment with the hand grip 5, end portions 23 and 23' of the longitudinal members 19 and 19' respectively will first encounter cam surfaces 32 and 32' and then cam surfaces 34 and 34'. The wrist brace means is spread slight in passing over cam surfaces 32, 32' and 34, 34' and after it passes over the inward tension of the wrist brace means forces or snaps it into grooves 25 and 25'. This prevents counterrotation. At the same moment the end portions 23 and 23' of the wrist brace means fall in the grooves 25 and 25', and encounter stop members 29 and 29' respectively, so that further rotation is precluded. With this placement, the wrist brace means is locked into shooting position.

The position and overhanging design features of stop members 29 and 29' place increasing inward pressure to the wrist brace means with increasing backward pressure on the handle grip 5. As a result, the wrist brace means is prevented from being spread apart.

The foregoing disclosure is representative of preferred forms of the invention and is to be interpreted in illustrative manner, rather than in a limiting sense, the invention to be accorded the full scope of the claims appended hereto.

It is claimed:

1. A folding slingshot comprising a yolk having a hand grip, elastic members connected to said yolk, wrist brace means frictionally, detachably and pivotably mounted to the hand grip near the base thereof, said wrist brace comprising a pair of longitudinal members diverging rearwardly from the hand grip and spaced apart to receive the wrist between them and an end member integral with said longitudinal members engageable with the user's wrist, a groove on each side of said handle near the base thereof for receipt of end portions of said longitudinal members, a protruding stop member on said hand grip overhanging each of said grooves for preventing further rotation of said wrist brace, a cam area on said hand grip below each of said grooves containing two spaced apart cam surfaces, said end portions of the longitudinal members encountering said cam surfaces successively upon rotation toward said grooves, thereby spreading slightly said longitudinal members so that after passing over said cam surfaces, said end portions of the longitudinal members snap into said grooves and rest against said respective stop members to lock said wrist brace means in shooting position.

2. The slingshot of claim 1 wherein the yolk comprises a continuous bar member bent so as to comprise a forked portion and a doubled-over stem portion, said stem portion being positioned and secured within the hand grip.

3. The slingshot of claim 2 wherein the grip handle comprises two concave sections, one section containing at least two spaced apart male members and the other section containing corresponding female members receiving said male members, and the stem portion of said yolk passing around at least two of said coupled male and female members.

4. The slingshot of claim 3 wherein the ends of the pair of longitudinal members are frictionally, detachably and pivotably mounted in the opposite openings of a hole passing through the base of said hand grip on a plane parallel to said base.

5. The slingshot of claim 4 wherein each said elastic member is a rubber tube having a missile pouch connected thereto.

6. The slingshot of claim 1 wherein the wrist brace means folds upward away from the shooting position into contact with the fork portion of said yolk.

* * * * *